US007269268B2

(12) United States Patent
Song et al.

(10) Patent No.: US 7,269,268 B2
(45) Date of Patent: Sep. 11, 2007

(54) SMD TYPE BIASED CONDENSER MICROPHONE

(75) Inventors: Chung Dam Song, Seoul (KR); Eek Joo Chung, Gimpo-si (KR); Hyun Ho Kim, Incheon (KR)

(73) Assignee: BSE Co., Ltd. (KR)

( * ) Notice: Subject to any disclaimer, the term of this patent is extended or adjusted under 35 U.S.C. 154(b) by 510 days.

(21) Appl. No.: 10/985,609

(22) Filed: Nov. 10, 2004

(65) Prior Publication Data

US 2005/0123155 A1 Jun. 9, 2005

(30) Foreign Application Priority Data

Dec. 4, 2003 (KR) ..... 10-2003-0087532

(51) Int. Cl.
*H04R 25/00* (2006.01)

(52) U.S. Cl. ..... 381/174; 381/113

(58) Field of Classification Search ..... 381/111, 381/113, 174, 175, 369; 367/174, 178, 181; 330/301

See application file for complete search history.

(56) References Cited

U.S. PATENT DOCUMENTS 4,491,697 A * 1/1985 Tanaka et al. ..... 381/113
6,057,737 A * 5/2000 Pritchard ..... 330/300
7,146,016 B2 * 12/2006 Pedersen ..... 381/175

* cited by examiner

*Primary Examiner*—Curt Kuntz
*Assistant Examiner*—Tuan Duc Nguyen
(74) *Attorney, Agent, or Firm*—Keusey, Tutunjian & Bitetto, P.C.

(57) ABSTRACT

A surface mounted device (SMD) type biased condenser microphone includes two terminals for a surface mounting process. The SMD type biased condenser microphone includes a grounding terminal for connecting with an external circuit, a diaphragm/backplate set, one end of which is connected to the grounding terminal, for varying a capacity according to an intensity of sound pressure and converting sound into an electric signal, a DC-DC converter for providing a bias voltage so as to form an electrostatic field at one side of the diaphragm/backplate set, a buffer IC for amplifying the electric signal from the diaphragm/backplate set, and a decoupling capacitor for preventing the bias voltage output from the DC-DC converter from being directly applied to the buffer IC and transferring the electric signal from the diaphragm/backplate set to the buffer IC.

6 Claims, 4 Drawing Sheets

SMD TYPE BIASED CONDENSER MICROPHONE

BACKGROUND OF THE INVENTION

1. Field of the Invention

The present invention relates to a biased condenser microphone, and more particularly, to an SMD (surface mounting device) type biased condenser microphone having two connecting terminals for a surface mounting.

2. Description of the Related Art

Generally, a condenser microphone includes a set of diaphragm and backplate provided with a capacitor (C), the capacitance of which is changed depending on a voltage bias factor and a sound pressure, and a junction field effect transistor (JFET) for buffering an output signal.

As an example of such a condenser microphone, there is a biased condenser microphone in which a bias voltage is supplied from the outside to form an electrostatic field between the diaphragm and the backplate.

FIG. 1A is an equivalent circuit diagram of a conventional biased condenser microphone. A microphone capsule 10 including a buffer IC 14 and a variable condenser 12 in a microphone unit is connected through three terminals 16-1, 16-2 and 16-3 to an external circuit. The first terminal 16-1 is used to connect an output portion of the buffer IC 14 through a resistor R1 to a power source Vdd and, at the same time, through a capacitor to a signal output portion, and the second terminal 16-2 is used to connect the buffer IC 14 to a grounding portion GND. Also, the third terminal 16-3 is used to supply a bias voltage to the microphone unit.

FIG. 1B is another equivalent circuit diagram of the conventional biased condenser microphone. The microphone capsule 10 including the buffer IC 14 and the variable condenser 12 in the microphone unit is also connected through three terminals 16-1, 16-2 and 16-3 to an external circuit. The first terminal 16-1 is used to supply a bias voltage through a resistor R2 to the microphone unit and the second terminal is used to connect an output portion of the buffer IC 14 through a resistor R1 to a power source Vdd and, at the same time, through a capacitor to a signal output portion. Also, the third terminal 16-3 connects the buffer IC 14 to the grounding portion GND.

However, since the conventional biased condenser microphone is provided with at least three terminals such as the bias terminal, the power and output terminal and the grounding terminal so as to interface with the outside, there is a problem that a direction of the circular condenser microphone should be checked upon a surface mounting process. Further, since a separate voltage device for supplying the bias voltage has to be provided to the outside of the microphone, it is difficult to miniaturize the microphone. Furthermore, since it has poor compatibility with an electret condenser microphone (ECM), which is generally used for connection with an external circuit, there is another problem that includes providing a printed circuit board (PCB), which has to be separately designed.

SUMMARY OF THE INVENTION

Accordingly, the present invention is directed to a biased condenser microphone that substantially obviates one or more problems due to limitations and disadvantages of the related art.

An object of the present invention is to provide an SMD type biased condenser microphone that can improve compatibility with a conventional ECM by including a two-terminal type device using a decoupling capacitor, and solve the directional problem of the circular condenser microphone in the surface mounting process, and also form the electrostatic field by applying a voltage from the outside so as to be capable of maintaining a constant electric field even after reflow work thereby preventing loss of sensitivity.

Another object of the present invention is to provide an SMD type biased condenser microphone in which a voltage pump IC having a built-in decoupling capacitor is mounted on a PCB of a microphone, and the voltage pump IC and a buffer IC are driven by a voltage supplied through a single voltage input terminal, and sensitivity can be adjusted by changing an intensity of electrostatic field between a diaphragm and a backplate according to an intensity of bias voltage amplified and transferred from an output terminal of the voltage pump IC.

To achieve these objects and other advantages and in accordance with the purpose of the invention, as embodied and broadly described herein, there is provided an SMD type biased condenser microphone, comprising a grounding terminal for connecting with an external circuit; a diaphragm/backplate set one end of which is connected to the grounding terminal, for varying a capacity according to an intensity of sound pressure and converting sound into an electric signal; a DC-DC converter for providing a bias voltage so as to form an electrostatic field at one side of the diaphragm/backplate set; a buffer IC for amplifying the electric signal from the diaphragm/backplate set; and a decoupling capacitor for preventing the bias voltage output from the DC-DC converter from being directly applied to the buffer IC and transferring the electric signal from the diaphragm/backplate set to the buffer IC.

Therefore, the present invention can improve compatibility with a conventional ECM, and solve the directional problem of the circular condenser microphone in the surface mounting process, and also form the electrostatic field by applying a voltage from the outside so as to be capable of maintaining a constant electric field even after reflow work thereby preventing loss of sensitivity.

Additional advantages, objects, and features of the invention will be set forth in part in the description which follows and in part will become apparent to those having ordinary skill in the art upon examination of the following or may be learned from practice of the invention. The objectives and other advantages of the invention may be reaLized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Unlike in the conventional way of forming an electrostatic field by a forcibly injected electret, in an operational principle of the present invention, an electrostatic field is formed between a backplate and a diaphragm by applying a des voltage from the outside and outputting an electric signal corresponding to vibration of the diaphragm through a buffer IC.

To supply the external power between the backplate and the diaphragm, the conventional microphone needs three external terminals, e.g., an external power supplying terminal, a signal outputting terminal and a grounding terminal. However, a condenser microphone of the present invention can be driven with two terminals.

First Embodiment

Figure 1A:
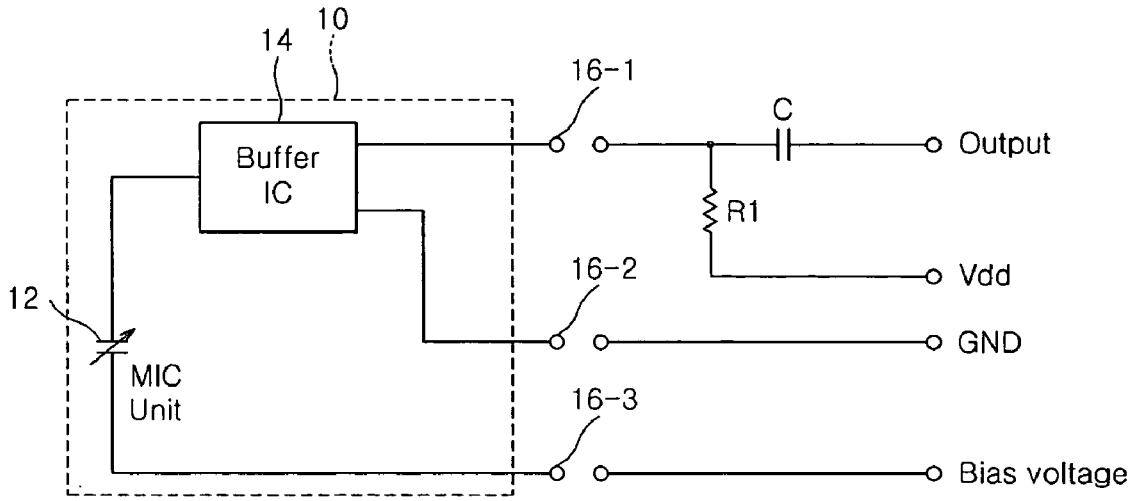
FIG. 1A (PRIOR ART)
FIGS. 1A and 1B are circuit diagrams of conventional bias condenser microphones.
Figure 1B:
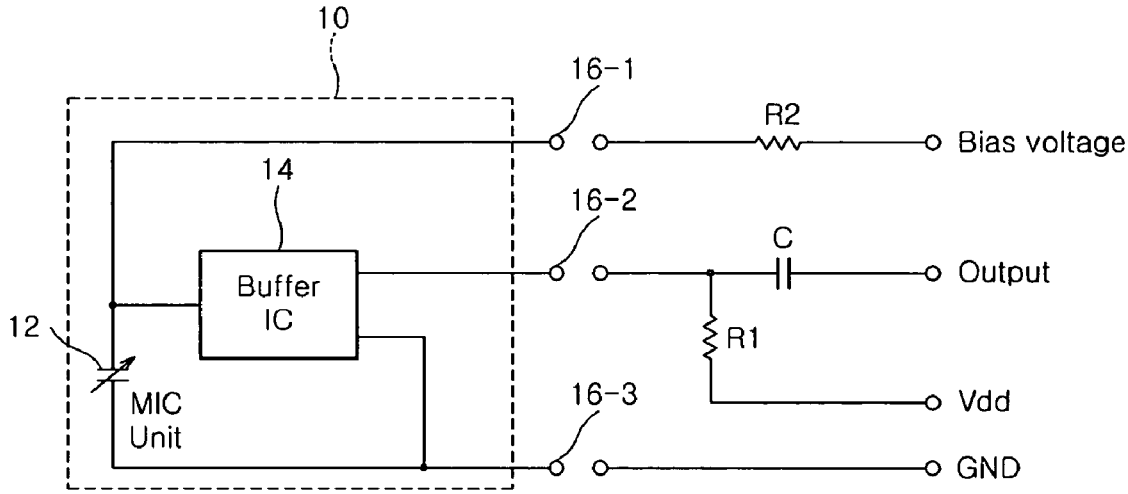
FIG. 1B (PRIOR ART)
Figure 2:
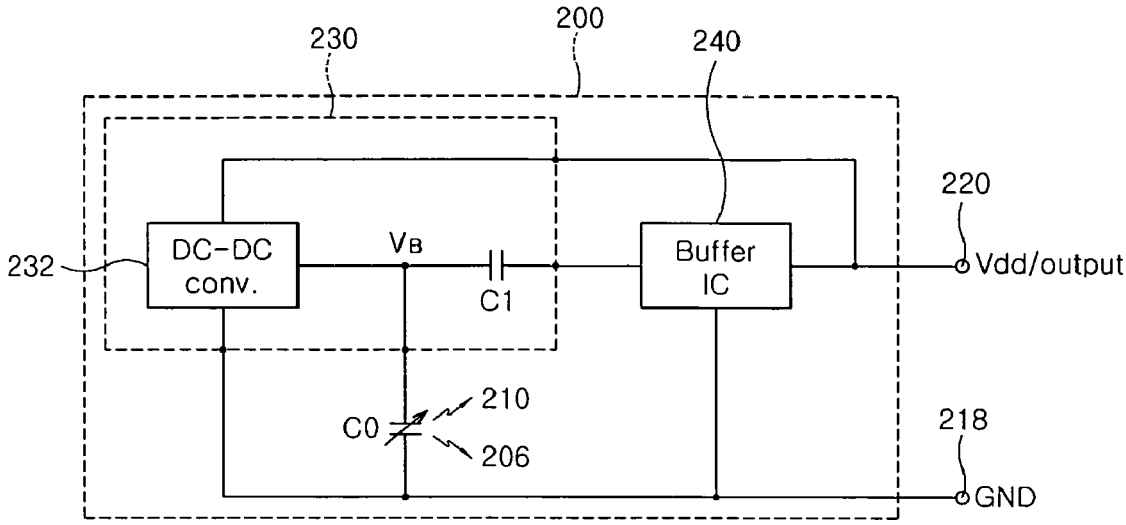
FIG. 2 is a circuit diagram of an SMD type condenser microphone according to a first embodiment of the present invention.
Figure 3:
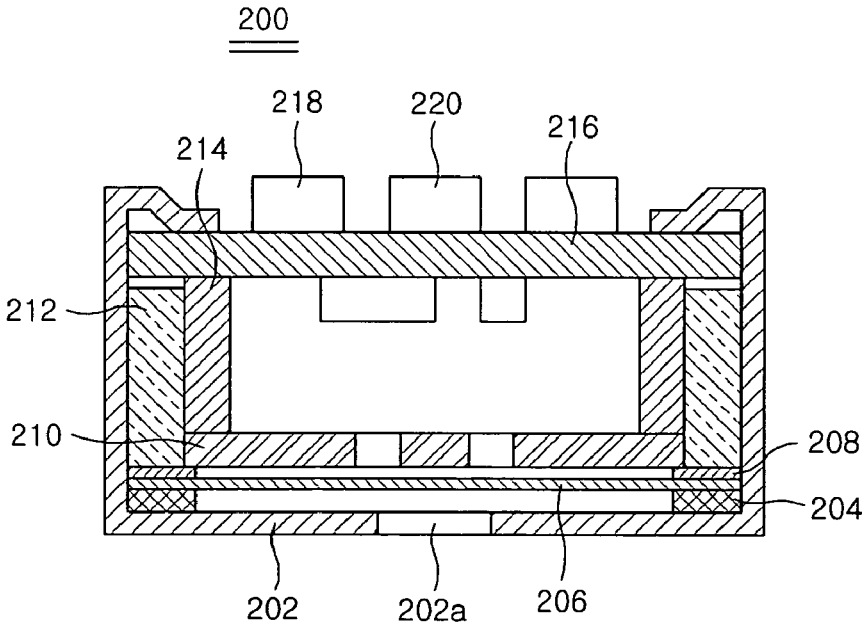
FIG. 3 is a cross-sectional view of the SMD type condenser microphone according to the first embodiment of the present invention.

FIG. 2 is a circuit diagram of an SMD type condenser microphone according to a first embodiment of the present invention, and FIG. 3 is a cross-sectional view of the SMD type condenser microphone according to the first embodiment of the present invention.

In the equivalent circuit according to a first embodiment of the present invention, as shown in FIG. 2, a diaphragm 206 and a backplate 210 are represented as a single variable condenser C0 so that the diaphragm 206 is connected to a grounding portion GND and the backplate 210 is connected to a DC-DC converter 232. A decoupling capacitor C1 is connected between the DC-DC converter 232 and a buffer IC 240. Herein, a voltage pump IC 230 is comprised of the DC-DC converter 232 and the decoupling capacitor C1, and the buffer IC 240 may include an FET, an amplifier or an analog-digital converter.

Meanwhile, in an internal PCB circuitry, if necessary, a circuit for connecting capacitors or capacitors, resistors, etc., in series or parallel may be added to a basic component such as the voltage pump IC 230 and the buffer IC 240 in order to improve a characteristic with respect to EMI or ESD.

In an SMD type biased condenser microphone according to a first embodiment of the present invention, as shown in FIG. 3, a sound inlet hole 202*a* is formed in a bottom surface. The diaphragm 206 integrally formed with a ring 204 is inserted into a cylindrical case 202, one surface of which is opened. On the diaphragm 206, there is provided a spacer 208 to secure a space between the backplate 210 and the diaphragm 206. A cylindrical first base 212 made of an insulating material is disposed on the spacer 208. The backplate 210 made of a metal plate is disposed at an inside portion of the first base 212 so as to be apart from the diaphragm by the spacer 208. On the backplate 210, there is provided a second base 214 made of a conductive material so as to electrically connect the backplate 210 with a circuit of a PCB 216. The PCB 216 on which components (voltage pump IC, buffer IC, etc.) are mounted is disposed thereon, and then an end of the case 202 is curled or conformed to secure or seal the surface.

Referring to FIG. 3, the backplate 210 is formed of a metal plate without a polymer series film so as to form the electret. The diaphragm 206 is formed of a metal film or formed by depositing a metal on one or both surfaces of an organic or inorganic film.

Figure 4:
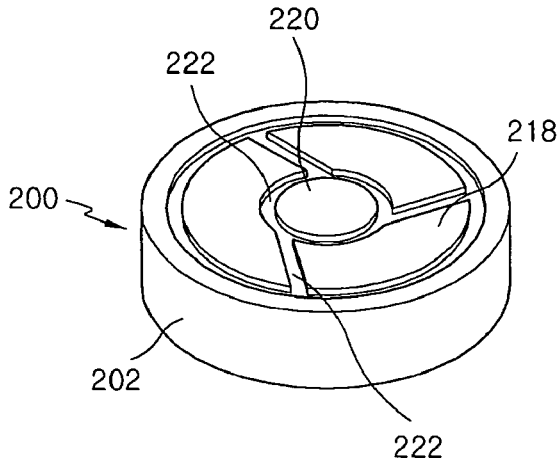
FIG. 4 is a perspective view of a connecting terminal of the condenser microphone of FIG. 3.

Meanwhile, as shown in FIG. 4, connecting terminals 218, 220 are formed on an exposed surface of the PCB 216 so as to be protruded further than the curled surface of the case 202, so that a microphone 200 can be attached to a main PCB (e.g., a PCB of a cellular phone) in an SMD type. To this end, as shown in FIG. 4, a circular terminal 220 for power and output connection Vdd/Out is formed at an inside portion, and a ring-shaped grounding terminal 218 is formed at the outside of the circular terminal 220 so as to be apart from the circular terminal 220 at a distance. The grounding terminal 218 is divided into three parts by three gas outlet grooves 222 for exhausting gas generated upon the SMD type attaching process.

An operation of the biased condenser microphone according to the first embodiment of the present invention will be described in detail.

Referring again to FIGS. 2 and 3, according to the first embodiment of the present invention, the driving voltage Vdd is applied through the power and output terminal 220 of the PCB 216 to the buffer IC 240 and the voltage pump IC 230, respectively. The applied driving voltage Vdd drives the buffer IC 240 and the voltage pump IC 230. The DC-DC converter 232 of the voltage pump IC 230 converts the driving voltage Vdd into a DC bias voltage $V_B$ amplified to a desired level. The bias voltage $V_B$ is applied through the second base 214 to the backplate 210. The grounding terminal 218 of the PCB 216 is commonly connected to the buffer IC 240 and the DC-DC converter 240, and at the same time, connected through the case 202 and the ring 204 to the diaphragm 206. Therefore, between the backplate 210 to which the bias voltage $V_B$ is applied and the grounded diaphragm 206, there is formed the capacitance C0 and the electrostatic field by the bias voltage $V_B$.

In this situation, if the diaphragm 206 is vibrated according to external sound pressure, an electric signal is generated. The electric signal is transferred through the backplate 210 and the second base 214 to the buffer IC 240 of the PCB 216, and amplified in the buffer IC 240, and then output through the power and output terminal 220 of the PCB 216 to the outside. According to the present invention, in order for the DC bias voltage $V_B$ output from the DC-DC converter 232 to be prevented from being directly applied to the buffer IC 240, the decoupling capacitor C1 is connected between an output portion of the voltage pump IC 230 and an input portion of the buffer IC 240. The decoupling capacitor C1 functions to prevent the DC bias voltage $V_B$ from being directly applied to the buffer IC 240 and allow only the electric signal generated by the vibration of the diaphragm 206 to be passed to the buffer IC 240, thereby separating the DC bias voltage $V_B$ from the electric signal.

Second Embodiment

Figure 5:
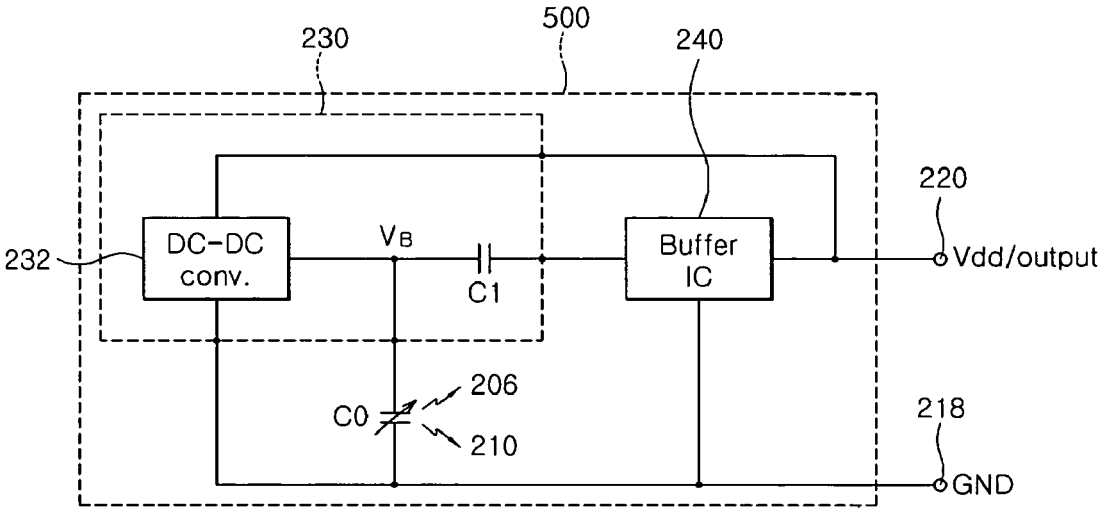
FIG. 5 is a circuit diagram of an SMD type condenser microphone according to a second embodiment of the present invention.
Figure 6:
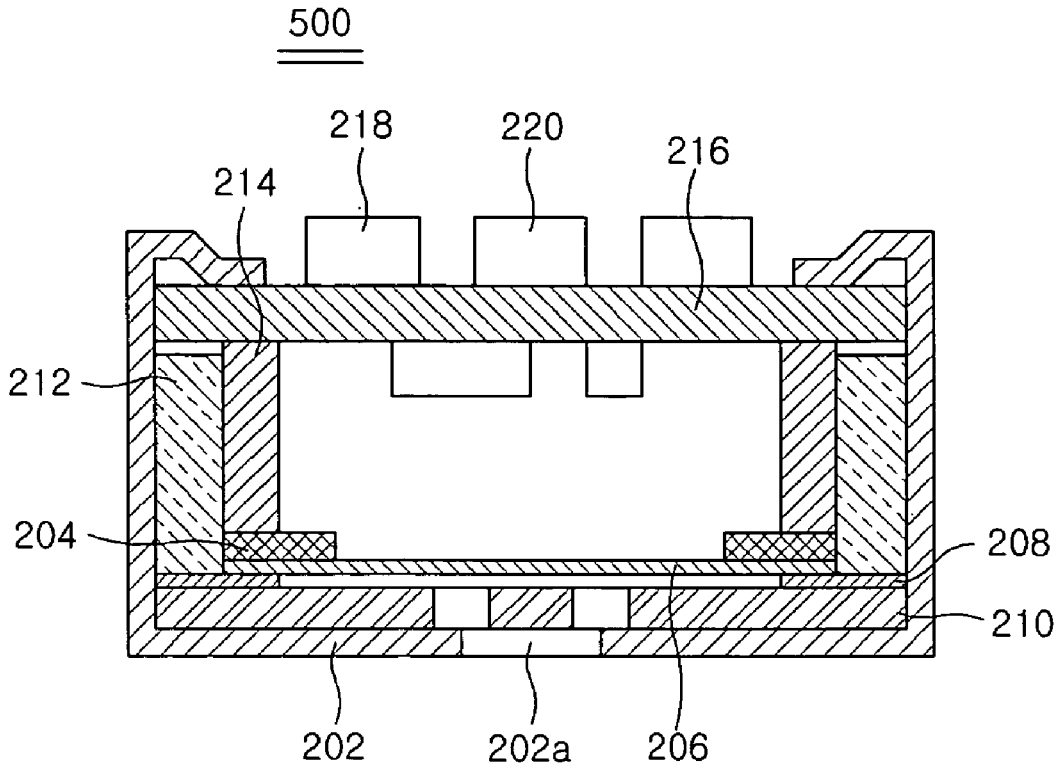
FIG. 6 is a cross-sectional view of the SMD type condenser microphone according to the second embodiment of the present invention.

FIG. 5 is a circuit diagram of an SMD type condenser microphone 500 according to a second embodiment of the present invention, and FIG. 6 is a cross-sectional view of the SMD type condenser microphone 500 according to the second embodiment of the present invention.

In comparison with the first and second embodiments of the present invention, since a structure of the second embodiment is entirely similar to that of the first embodiment except for relocation of the backplate 210 and the diaphragm 206, the description of the same or similar parts will be omitted.

Referring to FIGS. 5 and 6, in the circuit of the second embodiment compared with the equivalent circuit of the first embodiment, the variable condenser C0 is equivalent to the backplate 210 and the diaphragm 206, and the backplate 210 is connected to the grounding portion, and the diaphragm 206 is connected to the DC-DC converter 232.

That is, in the second embodiment, the driving voltage Vdd is applied through the power and output terminal Vdd/output 220 of the PCB 216 to the buffer IC 240 and the voltage pump IC 230, respectively. The applied driving voltage Vdd drives the buffer IC 240 and the voltage pump IC 230. The DC-DC converter 232 of the voltage pump IC 230 converts the driving voltage Vdd into the DC bias voltage $V_B$ amplified to a desired level. The bias voltage $V_B$ is applied through the second base 214 and the ring 204 to the diaphragm 206. The grounding terminal 218 of the PCB 216 is commonly connected to the buffer IC 240 and the DC-DC converter 240, and at the same time, connected through the case 202 to the backplate 210. Therefore, between the grounded backplate 210 and the diaphragm 206 to which the bias voltage $V_B$ is applied, there is formed the capacitance C0 and the electrostatic field by the bias voltage $V_B$.

In this state, if the diaphragm 206 is vibrated according to external sound pressure, an electric signal is generated. The electric signal is transferred through the ring 204 and the second base 214 to the buffer IC 240 of the PCB 216, and amplified in the buffer IC 240, and then output through the power and output terminal 220 of the PCB 216 to the outside. According to the present invention, in order for the DC bias voltage $V_B$ output from the DC-DC converter 232 to be prevented from being directly applied to the buffer IC 240, the decoupling capacitor C1 is connected between the output portion of the voltage pump IC 230 and an input portion of the buffer IC 240. The decoupling capacitor C1 functions to prevent the DC bias voltage $V_B$ from being directly applied to the buffer IC 240 and allow only the electric signal generated by the vibration of the diaphragm 206 to be passed to the buffer IC 240, thereby separating the DC bias voltage $V_B$ from the electric signal.

As described above, an SMD type biased condenser microphone according to the present invention can improve compatibility with the conventional ECM by forming into two-terminal (the power/output terminal and the grounding terminal type using the decoupling capacitor, and solve the directional problem of the circular condenser microphone in the surface mounting process, and further form the electrostatic field by applying the voltage from the outside so as to be capable of maintaining the constant electric field without the loss of sensitivity due to the reflow work at a high temperature. In addition, in the SMD type biased condenser microphone of the present invention, the voltage pump IC is mounted on a PCB of a microphone, and the voltage pump IC and a buffer IC are driven by the same voltage as that in conventional microphone, and the sensitivity can be adjusted according to the intensity of bias voltage amplified and transferred from the output terminal of the voltage pump IC.

It will be apparent to those skilled in the art that various modifications and variations can be made in the present invention. Thus, it is intended that the present invention covers the modifications and variations of this invention provided they come within the scope of the appended claims and their equivalents.

What is claimed:

1. An surface mounted device (SMD) type biased condenser microphone, comprising:

a grounding terminal for connecting with an eternal circuit;

diaphragm/backplate set, one end of which is connected to the grounding terminal, for varying a capacity according to an intensity of sound pressure and converting sound into an electric signal;

a direct current-direct current (DC-DC) converter for providing a bias voltage so as to form an electrostatic field at one side of the set of diaphragm/backplate;

a buffer integrated circuit (IC) for amplifying the electric signal from the diaphragm/backplate set; and a decoupling capacitor for preventing the bias voltage output from the DC-DC converter from being directly applied to the buffer IC and transferring the electric signal from the diaphragm/backplate set to the buffer IC.

2. The microphone of claim 1, wherein the diaphragm of the diaphragm/backplate set is connected to the grounding terminal, and the backplate thereof is connected to the DC-DC converter so as to receive the bias voltage.

3. The microphone of claim 1, wherein the backplate of the diaphragm/backplate set is connected to the grounding terminal, and the diaphragm thereof is connected to the DC-DC converter so as to receive the bias voltage.

4. The microphone of claim 1, wherein the DC-DC converter and the decoupling capacitor are integrated into a voltage pump IC.

5. The microphone of claim 1, wherein the buffer IC includes one of a field effect transistor (FET), an amplifier and an analog-digital converter.

6. The microphone of claim 4, wherein the voltage pump IC and the buffer IC are integrated into a same IC.

* * * * *